United States Patent [19]

Chiodi et al.

[11] 4,038,621

[45] July 26, 1977

[54] PRECISION VERTICAL DEFLECTION COIL FOR A HYBRID TELEVISION YOKE

[75] Inventors: Wayne R. Chiodi, Northbrook; Bryan R. Grummon, Oak Park, both of Ill.

[73] Assignee: Zenith Radio Corporation, Glenview, Ill.

[21] Appl. No.: 667,918

[22] Filed: Mar. 16, 1976

[51] Int. Cl.[2] ..... H01F 1/00

[52] U.S. Cl. ..... 335/213; 335/210

[58] Field of Search ..... 335/210, 213

[56] References Cited

U.S. PATENT DOCUMENTS

| | | | |
|---|---|---|---|
| 3,246,192 | 4/1966 | Torsch | 335/213 X |
| 3,321,724 | 5/1967 | Obert | 335/213 |
| 3,757,262 | 9/1973 | Over et al. | 335/213 |

*Primary Examiner*—George Harris
*Attorney, Agent, or Firm*—Jack Kail

[57] ABSTRACT

An electromagnetic deflection yoke includes saddle wound horizontal deflection coils mounted to a liner. The vertical coils are toroidally wound on a smooth, magnetically permeable core having the form of a segmented frusto-conic section and are in contact with the opposite side of the liner. Each vertical coil comprises a repeatable multilayer precision stack of wire turns with only the wire turns providing the support for maintaining the multilayer precision stack. The core has positioning notches which mate with locating tabs on the liner and provide for an accurate positioning of the vertical deflection coils with respect to the horizontal deflection coils.

6 Claims, 6 Drawing Figures

PRECISION VERTICAL DEFLECTION COIL FOR A HYBRID TELEVISION YOKE

BACKGROUND OF THE INVENTION

This invention relates to deflection yokes for television cathode ray tubes.

Both color and monochrome cathode ray tubes employ deflection yokes positioned to horizontally and vertically deflect the electron beam or beams over phosphor covered viewing screens. There are two common types of yoke winding configurations: saddle and toroidal. Frequently, different types of winding configurations are employed for the separate functions of horizontal and vertical deflection. Such an arrangement is called a hybrid yoke. This invention relates specifically to hybrid yokes with toroidally wound vertical deflection coils on a substantially frusto-conic core of magnetically permeable material.

The prior art describes deflection coils of both winding configurations. In the vast consumer-product market, performance and cost to the consumer are of paramount importance, cost readily translates into material, labor and uniformity of product. With respect to the latter, the art has many suggestions for making yokes with consistently repeatable characteristics. U.S. Pat. No. 3,878,490 to Logan describes a toroidal deflection yoke with individual wire wraps being held in place by an adhesive coating on the core. The adhesive resists wire movement, particularly for the first layer and thus attempts to prevent random wire positioning. U.S. Pat. No. 3,758,888 to Kadota employs wire guide rings to maintain wire positions, with partitions separating the various wire sections. U.S. Pat. No. 3,835,426 shows a toroidal deflection yoke having a core with a plurality of built-in grooves for positioning the coil wires.

Automatic machinery for toroidal coil winding is also well known in the art and U.S. Pat. No. 3,799,462 to Fahrback shows a typical device. The machine described is numerically controlled and responds to a punch tape program or a sequence of instructions. It is stated that this enables each turn of the windings to be accurately placed on the core.

The choice of which coil configuration is used is dependent upon many factors, including the type of cathode ray tube display device, the type and amount of correction desired to be incorporated and the drive system for the yoke. It is also well known that many deflection type errors may be minimized by the nature of the electron gun array and phosphor screen pattern of the tube and by tailoring the picture tube screen to a "nominal" yoke with which it will be used.

Recently cathode ray tubes having horizontal "in-line" electron guns and vertically striped screens have become popular, primarily because of the greater ease of obtaining convergence. The limited amount of dynamic convergence required in a well-designed tube of 90° or smaller deflection angle with "in-line" guns can even be taken up in the yoke design. Indeed, today some tubes are sold with full toroid yokes permanently attached. These tubes do not require dynamic convergence correction and both the tube and yoke are replaceable as a unit. Accuracy of wire placement is obtained by using two or less layers of wire, and precision ground cores with yoke forms having plastic wire guides, all of which are very expensive. Further, a toroidally wound horizontal coil is difficult to fully correct for deflection errors. For example, the above-mentioned tube full toroid yoke combination incorporates external top-bottom pincushion correction circuitry, which may readily be incorporated in saddle-wound horizontal coils. By way of comparison, even delta electron gun tubes of small deflection angle invariably need additional dynamic convergence windings for keeping the electron beams in reasonably good convergence throughout the screen area.

The main difficulty with the toroid winding is that of getting precision in a limited winding space. Ideally, each turn should occupy a precise location, and must, therefore, be physically restrained, which greatly reduces the room for the winding and increases the drive requirements. The available drive circuits use SCR devices, which are not only very expensive, but are not as reliable as conventional transistor drive circuits.

Adding more turns to the toroidally wound coil alleviates the drive requirement but destroys the accuracy of placement. Further, if good dynamic convergence is to be built into the yoke, a definite "winding profile" is needed to develop the appropriate deflection field for the proper beam location.

Additionally, the system using plastic liners with built-in wire guides must have a precise relationship between the liner and core. The standard ferromagnetic core material in use today is not sufficiently controllable as to size for this purpose and each core must be ground to proper dimension. This, of course, is very costly.

The yoke should also be rapidly and repeatably producible, that is "windable" on conventional tape controlled winding machines. There are hybrid yokes existent with randomly wound toroidal vertical deflection coils which do not use additional dynamic convergence. The errors introduced by the nonprecision winding of a multilayer toroidal vertical deflection coil is accepted, and a less than optimum display is tolerated.

Applicants' invention comprises a hybrid yoke in which the saddle-wound horizontal deflection coils are accurately aligned with the precision wound toroidal vertical coils. Each vertical coil is wound on a smooth, magnetically permeable core, in a repeatable multilayer precision stack of wire turns with only the wire turns themselves providing the support for maintaining the stack. The character and consistency of the display is not compromized.

The precision vertical coils of the deflection yoke of the invention lend themselves to manufacture on an automatic winding machine of conventional construction. An independently sequenced stepping operation of core advancement and wire flyer position readily permits positioning of the core with respect to the wire flyer and enables precision wire stacking. Multiple layers are built up in clusters on the core (with only wire turns providing support for the layers) rather than layer wrapping to the end and tracing back as in the art. This wire cluster arrangement reduces internal resonant currents.

The precision stack also enables precise alignment between the vertical and horizontal deflection coils. (Heretofore the sets of coils were positioned relative to each other in a separate operation in which their mutual interaction in an operating environment was observed.) In the preferred embodiment the liner has locating tabs and the cores have positioning notches. The completed vertical coils are just "dropped" into a unique position on the liner without the need for testing and adjustment. (The saddle horizontal coils are uniquely located on the underside of the liner.)

OBJECTS OF THE INVENTION

An object of this invention is to provide a novel yoke for a color television receiver.

Another object of this invention is to provide a precision hybrid deflection yoke for a color television cathode ray tube.

SUMMARY OF THE INVENTION

An electromagnetic deflection yoke comprises saddle wound horizontal deflection coils retained on one side of a liner, a magnetically permeable substantially smooth core adjacent the opposite side of the liner and a pair of vertical deflection coils toroidally wound in a wave sequence on the core each having a repeatable multilayer precision stack of wire turns with only the wire turns providing support for maintaining the multilayer precision stack.

DESCRIPTION OF THE PREFERRED EMBODIMENT

Figure 1:
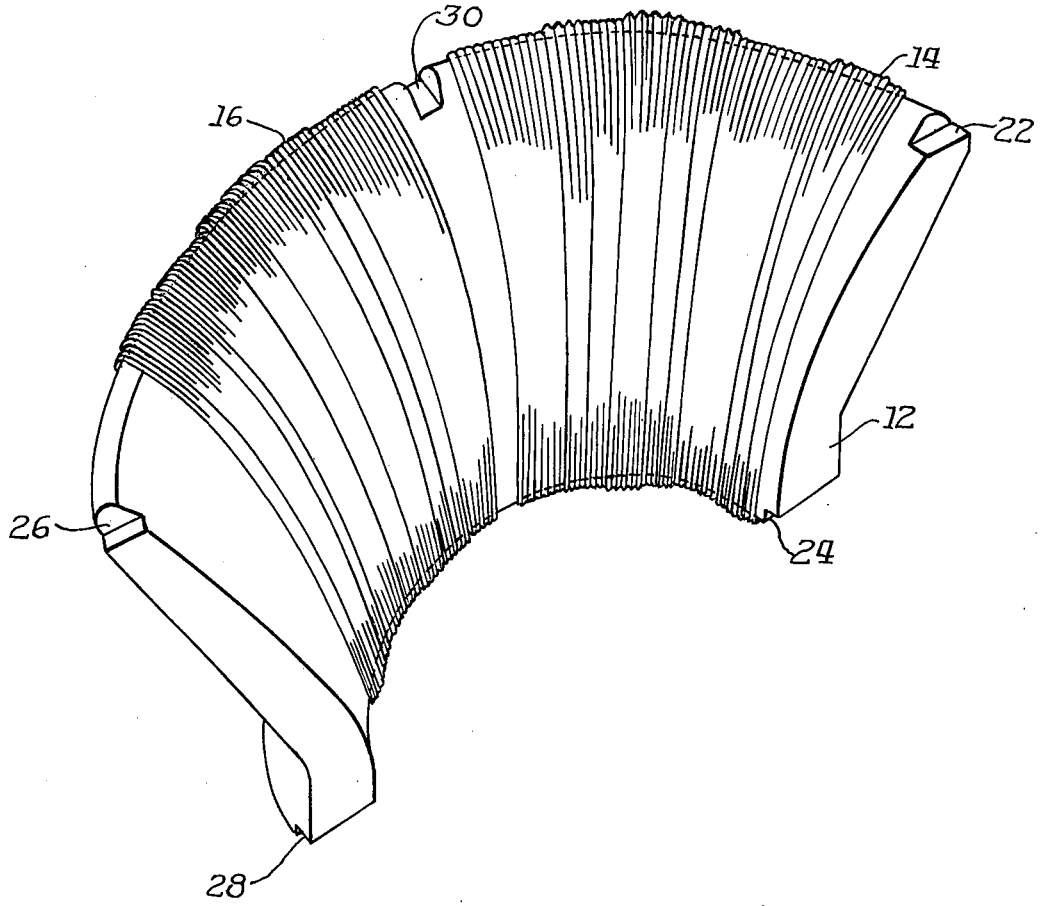
FIG. 1 shows, in perspective, the inside surface of one section of a multilayer precision stack wound vertical deflection coil.

In FIG. 1, one section of a fully wound vertical deflection coil is shown. A magnetically permeable core in the shape of a segment of a frusto-conic section 12 is shown having wire cluster patterns 14 and 16 wound thereon. The wire is wound directly upon the formed coils without guides or adhesives. Wire cluster patterns 14 and 16 show the precise stacking of the wire turns and each cluster pattern encompasses an angular sector along core 12.

At the end points of core segment 12 are shown positioning notches 22, 26, 24 and 28 with the former two being on the edge defined by the larger diameter and the latter two on the edge defined by the smaller diameter of the frusto-conic section. An additional positioning notch 30 is shown on the large diameter edge located between cluster patterns 14 and 16. It is this positioning notch along with positioning notches 22 and 26 which align a completed vertical coil with a horizontal coil as will be described later.

The view in FIG. 1 is of the inside of the winding coil that is, the side most closely adjacent to the cathode ray deflection tube. It may be observed that on this surface there are no wire cross-overs and the precision stacking of wire with only wire turns used to support the cluster patterns allows for this uniform arrangement.

Figure 2:
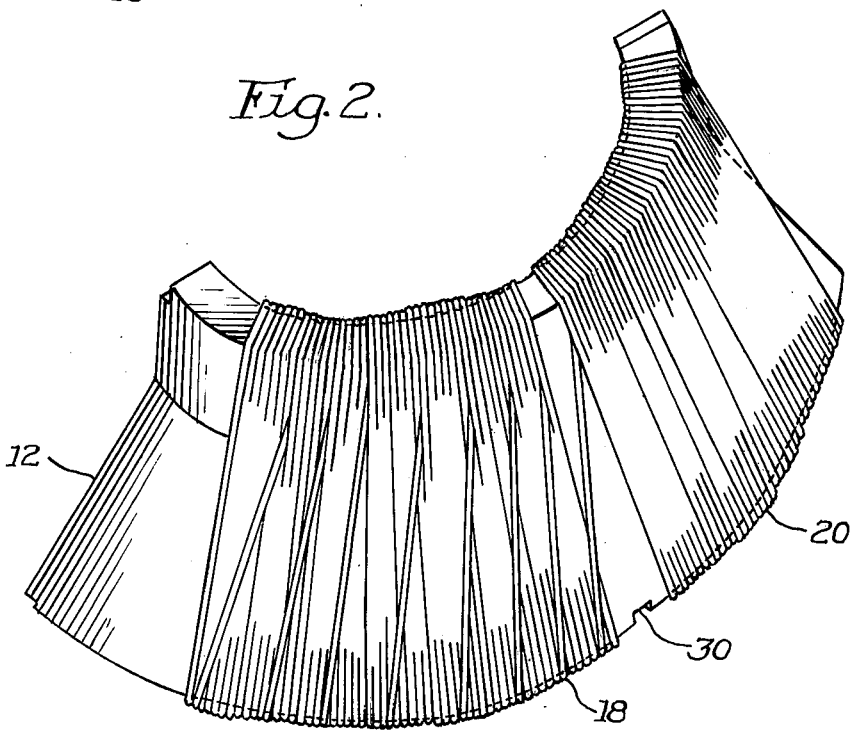
FIG. 2 shows, in perspective, the outside surface of the same section of vertical coil.

FIG. 2 shows the same segment of wound magnetically permeable core 12 but viewed from the outside surface. The two cluster pattern sectors appear somewhat different in this view and are designated as 18 and 20. It may be observed that a plurality of cross-over wires may be seen on this outside surface. The permeable core material shields the electron beams in a cathode ray tube from any magnetic influence of wires on this outside surface. At the small diameter inside surface edge, a distinct wire cluster pattern can be observed and this will be shown in greater detail in additional figures. Only half of the completed vertical core is shown, it should be noted that each half or segment is separately wound and the halves are then mechanically coupled together to form an entire vertical deflection coil.

Although not shown the machine used for automatically winding the vertical coils of the preferred embodiment is a numerically controlled toroidal coil winding machine manufactured by Universal Manufacturing Company which has the capacity to sequence and synchronize the angular position of the core to the flyer with a stepping motor. The machine has been modified so that the wire flyer supply tube is extended to approach the coil as closely as possible. This is to insure that the wire flyer position is closely translated to a particular wire laydown position during the wrapping of a turn.

The winding process requires accurate positioning of the core segments. Each core segment is initially aligned in a jig by utilizing reference points 26 and 28 shown in FIG. 1 and adjusting the core segment in the jig so that the large diameter of the conic section is in a predetermined plane. The core is then clamped and six degrees of freedom, 3 translations and 3 tilt angles, are fixed. The jig is then mounted in a corresponding fixture on the coil winding machine and wire is drawn across the coil and attached to a locking device on the mounting fixture. The program which is normally on punched paper tape is then sequenced to a start position. The start position indexes to a predetermined angle on the core and advances the wire flyer also to a predetermined position. This start position has been determined so that the first point of contact between the wire and the core is well known. The program is then sequenced through each of its individual instructions advancing or reversing the core position and the wire flyer positions. It has been found that accurate positioning of the wire can be conveniently achieved by a multiple readjusting of the relative positions of the flyer and the core during the wrapping of an individual turn.

During the initial wrapping for some wire cluster patterns locking turns are put down in that the first few turns are layed down in a direction opposite to the normal direction for winding the core segment and provides additional support for the resultant cluster pattern for this segment. For other wire cluster patterns locking turns may be positioned in the normal direction. The winding operation proceeds under the direction of program sequenced instructions and multilayer cluster patterns are produced directly on the magnetically permeable core. The wire pattern itself provides support for the cluster. The multilayer cluster patterns are produced in this manner and the core is advanced until the extremity for the cluster pattern sector is reached. At this point, additional locking turns are provided to insure additional support for the cluster pattern in that segment. The core is then advanced to the beginning of the cluster pattern for the next sector and the process continues under the direction of the program. The cluster patterns produced in various sectors of the core are not necessarily mirror images of each other rather each may be unique depending upon the design and is formed by the sequenced program instructions. After the last locking turn for the last cluster pattern on the sector of the core has been positioned, the program tape comes to an end. The split vertical coil is then removed from the fixture and the entire process repeated to produce another section of the vertical coil.

Figure 3:
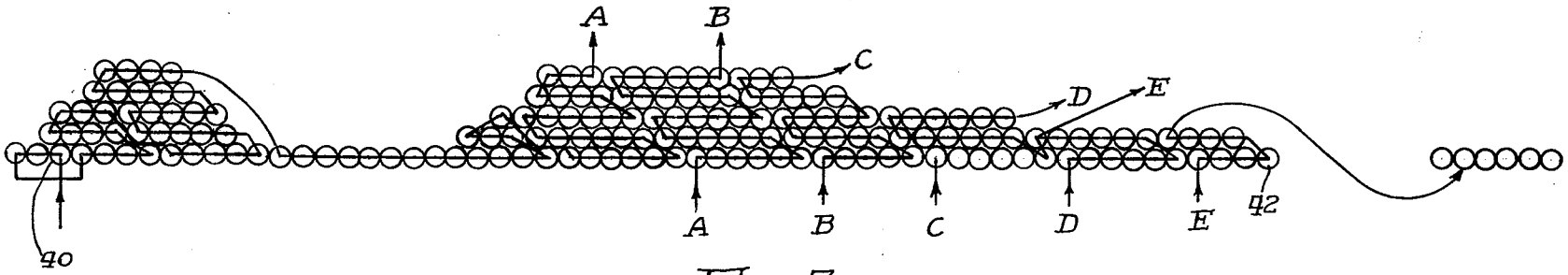
FIG. 3 shows one wire cluster pattern winding sequence at the inside edge of the small diameter for one sector of the vertical coil.

A wire cluster pattern is shown in FIG. 3. The term cluster is used to designate a distinguishable profile of multilayers of wires formed by repetitions of winding sequences. FIG. 3 may be said to contain two clusters, the first one being in the shape of a hill at the beginning of the winding pattern and the second being a plateau for the latter part of the cluster winding. The entire cluster pattern shown encompasses one sector on a core.

The actual winding sequence is shown (shown by a continuous arrow line) beginning at 40. The winding continues displaying the repetitive pattern of laying down anchor or locking turns at the beginning of the segment in a direction opposite to that of normally winding the cluster pattern. As additional wires are layed down, it may be observed that locking turns are provided on a lower layer prior to laying turns down on an upper layer. This sequence is repeated throughout the entire cluster pattern. As the winding leaves the diagram at a given point, a letter is used to indicate that point and the same letter designates the corresponding point on the opposite side of the wire cluster pattern. It may also be observed that at 42 locking turns are additionally positioned to provide support for the entire cluster pattern.

It should be noted that although the diagram is shown in a horizontal plane the wire cluster pattern is actually built on the inside surface at the small diameter of the frusto-conic section and because of this in actuality the geometry is slightly distorted. The wires shown appear to be in perfect hexagonal array but, because of the diminishing space due to the circular geometry, the wire spacing available at higher levels is somewhat smaller than at the lower levels. The overall winding sequence in FIG. 3 may be described as a wave sequence in that clusters are built up in a back and forth winding sequence with no more than five or six turns in each horizontal advancement. This sequence is repeated throughout the winding of the cluster patterns. This arrangement reduces internal resonant currents.

Figure 4:
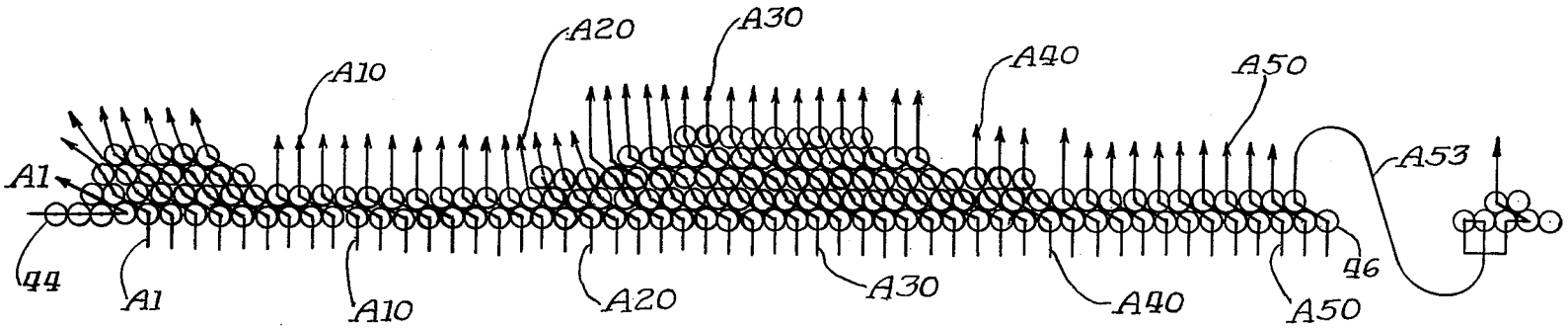
FIG. 4 shows another wire cluster pattern winding sequence at the same edge.

FIG. 4 shows a second wire cluster pattern which is begun at 44 and commences by laying four turns as additional anchoring for the entire wire cluster sector. The cluster pattern is then generated as shown by the plurality of arrows. After the four anchoring turns have been positioned the pattern is shown retracing at point A1 and restarting on the lower level at corresponding A1. Although not labelled on the opposite side of the diagram for each turn, the sequence is repeated throughout the entire cluster pattern until at 46 the wire sequence is terminated forming the final locking turn for this sector of the cluster pattern. Again, it should be mentioned that this is shown as a normal hexagonal array however in actuality the windings are on the inside surface of the smaller diameter of the frusto-conic section. At A53 the wire is directed off to commence winding of a second cluster pattern sector.

Positions 40 and 44 in FIGS. 3 and 4 respectively along with positions 42 and 46 have been uniquely predetermined and may be precisely located on the core. It is the precision location of wire cluster patterns which allows for the accuracy of resultant magnetic fields. Moreover, these fixed points are easily reproduceable from core to core so that the same pattern may be generated at the same position on an entire series of core segments. This generates a reproduceability of vertical deflection cores which has heretofore been unattainable in the prior art. The multilayer patterns shown include up to five layers of wires thus allowing more turns and a larger overall inductance of the coil and permitting smaller values of current to be used for driving the vertical deflection coil.

Figure 5:
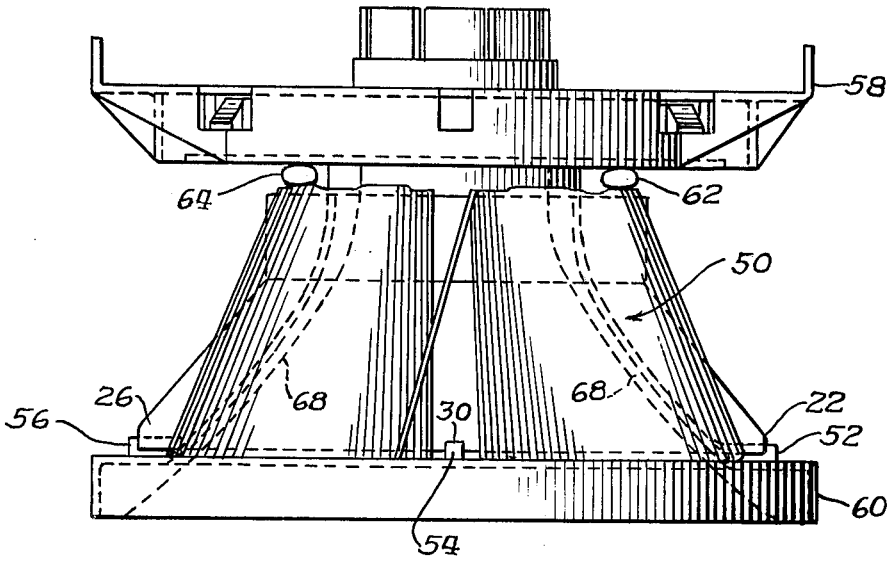
FIG. 5 shows a hybrid yoke having a completed vertical deflection coil contacting the liner and mounted in position relative to the horizontal coil.

FIG. 5 shows a fully wound completed vertical deflection coil 50 positioned adjacent to the horizontal coil. A plastic liner 60 has positioning tabs 52, 54 and 56 mating with positioning notches 22, 30 and 26 respectively of vertical coil 50. Although not shown an additional notch diammetrically opposed to 30 engages an additional positioning tab of liner 60 and provides for the precision alignment of the vertical coil relative to the horizontal. The plastic liner 60 is designed to exactly fit the carefully wound saddle horizontal deflection coils. The liner and coils have several surfaces in contact with each other and these along with edge flanges retain the horizontal coils in a unique position fixed relative to the liner. Because of the view for FIG. 5 the saddle wound horizontal coil is not visible. Liner 60 is coupled to a flange 58 which includes an axially centered cylindrical clamping device for attaching the yoke to the neck of a cathode ray tube. Spacers 62 and 64 are shown in contact with flange 58 and vertical coil 50 and are used to provide an engaging force between the positioning tabs and notches which levels the coil on front flange 60. The six degrees of freedom are therefore specified resulting in orthogonal coaxially centered magnetized fields of the energized yoke coils having deflection centers aligned appropriately.

Figure 6:
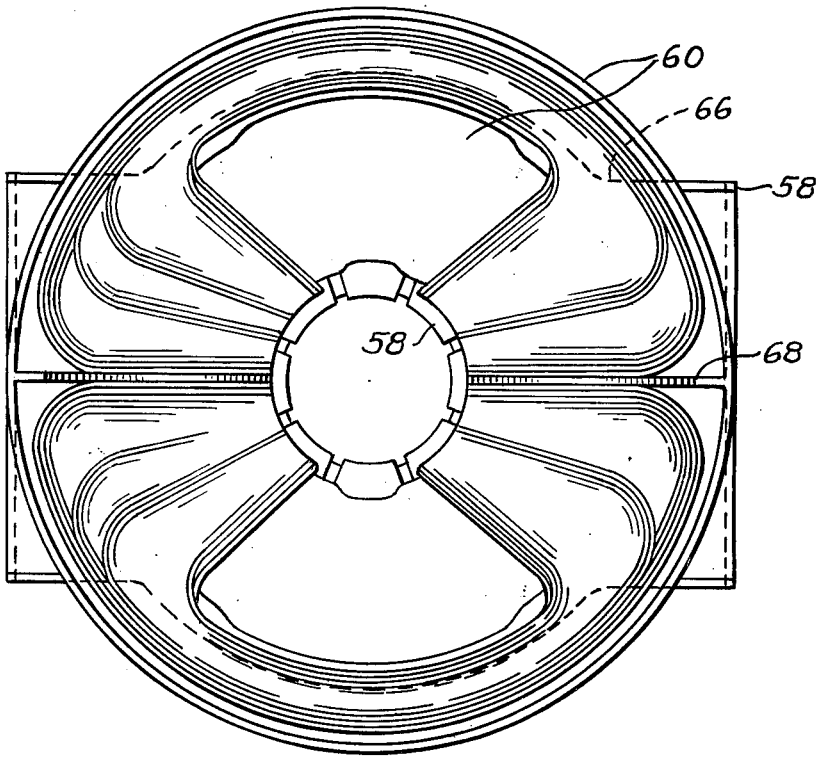
FIG. 6 shows the front view of the completed hybrid yoke.

FIG. 6 shows the front view for FIG. 5. Flange 58 is clearly visible projecting outside the circular geometry of a horizontal deflection coil 66. Horizontal deflection coil 66 shown in this figure is a two section saddle wound coil separated by a flange 68 on liner 60. At the center of the circular geometry may be seen the cylindrical attachment mechanism of flange 58. No part of the vertical deflection coil may be observed in this view but its position with respect to the horizontal deflection coils may be determined by FIGS. 5 and 6.

None of the electrical connections have been shown to either the horizontal or vertical coil nor have any electrical connections been shown extending from either liner 60 or flange 58. It is believed to be well known to those skilled in the art that such electrical connections are necessary and may be brought out at any convenient point which does not interfere with the locking mechanism aligning the vertical and horizontal coils. The spacing materials 62 and 64 may be of any convenient insulating material for the preferred embodiment.

What has been shown is a repeatable multilayer self-supporting precision wire stack wound vertical deflection coil for a hybrid television deflection yoke. Because of the repeatability the vertical and horizontal coils, although separately manufactured, may be locked together to form an accurate deflection yoke. This provides improved television display along with a substantial cost savings.

While there have been described particular embodiments of the present invention, it is apparent that changes and modifications may be made therein without departing from the invention in the broader aspects. The aim of the appended claims, therefore, is to cover all such changes and modifications as fall within the true spirit and scope of the invention.

What is claimed is:

1. An electromagnetic deflection yoke comprising:

a liner;

saddle wound horizontal deflection coils mounted on one side of said liner;

a magnetically permeable substantially smooth core adjacent the opposite side of said liner; and a pair of vertical deflection coils toroidally wound in a wave sequence on said core, each having a repeatable multilayer precision stack of wire turns with only said wire turns providing support for maintaining said multilayer precision stack.

2. The electromagnetic deflection yoke of claim 1, wherein said multilayer precision stack is wound in cluster patterns with said clusters beginning and ending at predetermined positions on said core.

3. The electromagnetic deflection yoke of claim 2, wherein said cluster patterns have substantially no cross-over wires on the core surface adjacent to said liner.

4. The electromagnetic deflection yoke of claim 3, wherein said cluster patterns encompass distinct sectors of said core and further include multiple locking turns at the extremities of said patterns to provide added support.

5. The electromagnetic deflection yoke of claim 4, wherein said core includes positioning means and said liner also includes locating means mating with said positioning means to fix the position of said vertical deflection coils relative to said horizontal deflection coils.

6. The electromagnetic deflection yoke of claim 5, wherein said core comprises a two segment frusto-conic section having a front-to-back ratio of diameters of approximately 2 to 1, with each segment bearing a different one of said pair of vertical deflection coils.

* * * * *